US008967021B2

(12) United States Patent
Hisada et al.

(10) Patent No.: US 8,967,021 B2
(45) Date of Patent: Mar. 3, 2015

(54) OPERATING DEVICE

(71) Applicant: Kabushiki Kaisha Tokai Rika Denki Seisakusho, Aichi (JP)

(72) Inventors: Masahito Hisada, Aichi (JP); Yoshinori Takano, Aichi (JP); Yoshiyuki Aoki, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 13/734,022

(22) Filed: Jan. 4, 2013

(65) Prior Publication Data

US 2013/0175147 A1 Jul. 11, 2013

(30) Foreign Application Priority Data

Jan. 10, 2012 (JP) ..... 2012-002181

(51) Int. Cl.

| | |
|---|---|
| ***G05G 1/10*** | (2006.01) |
| ***H01H 19/14*** | (2006.01) |
| *G05G 1/08* | (2006.01) |
| *H01H 3/02* | (2006.01) |
| *H01H 9/18* | (2006.01) |
| *H01H 25/06* | (2006.01) |

(52) U.S. Cl.

CPC ..... *H01H 19/14* (2013.01); *G05G 1/08* (2013.01); *G05G 1/105* (2013.01); *H01H 3/0213* (2013.01); *H01H 9/182* (2013.01); *H01H 25/06* (2013.01)

USPC ..... 74/553

(58) Field of Classification Search

USPC ..... 74/553; 200/11 R, 336

See application file for complete search history.

(56) References Cited

U.S. PATENT DOCUMENTS

| | | | | |
|---|---|---|---|---|
| 4,779,305 | A * | 10/1988 | Gorsek | 16/441 |
| 7,342,186 | B2 * | 3/2008 | Montalvo et al. | 200/11 R |
| 7,521,640 | B2 * | 4/2009 | Kodama et al. | 200/336 |
| 7,908,713 | B2 * | 3/2011 | Yoshinaka et al. | 16/441 |
| 2005/0064808 | A1 * | 3/2005 | Ogawa et al. | 454/69 |
| 2005/0098642 | A1 | 5/2005 | Ogawa et al. | |
| 2007/0029181 | A1 * | 2/2007 | Ogawa | 200/336 |
| 2008/0263830 | A1 | 10/2008 | Yoshinaka et al. | |

FOREIGN PATENT DOCUMENTS

JP 2005-96579 4/2005

OTHER PUBLICATIONS

Chinese Office Action issued on May 6, 2014 in Chinese Patent Application No. 2012-105705368.

Chinese Office Action issued in Chinese Patent Application No. 201210570536.8 on Oct. 31, 2014.

* cited by examiner

*Primary Examiner* — Vicky Johnson

(74) *Attorney, Agent, or Firm* — Morgan, Lewis & Bockius LLP

(57) ABSTRACT

An operating device includes a dial that has a first engagement portion, a rotational body that is formed in an annular shape, and has a second engagement portion so as to be engaged with the first engagement portion of the dial. Rotation of the dial is transmitted to the rotational body through an engagement of the first and second engagement portions. The operating device also includes gear teeth that are provided on an inner circumferential portion of the rotational body, a gear that is meshed with the gear teeth and is rotated in an inner space of the rotational body, and a rotation response member that is directly coupled to a rotation shaft of the gear and varies in accordance with a rotation angle of the dial.

8 Claims, 4 Drawing Sheets

OPERATING DEVICE

BACKGROUND

The present invention relates to a dial type operating device.

In the related art, for example, there is an operating device shown in FIG. 4 as an operating device which is provided for an air conditioning operation of vehicles. In the operating device, from the left side in FIG. 4, a dial 1, an indication piece 2, a display panel 3, a panel support 4, a body 5, a push button 6, a light guiding piece 7, an intermediate gear 8, a switch 9, a LED 10, resistors 11 to 13, an insulator 14, a lamp 15, a final stage gear 16, a housing 17, and a pulley unit 18 are present in this order.

The dial 1 is formed in a hollow short cylindrical shape. The indication piece 2 is mounted on one place of an inner circumferential portion of the dial. The front end of the indication piece 2 is exposed forward from a recessed portion 19 of a leading edge of the dial 1. In addition, gear teeth 20 are formed in an inner circumferential portion of a rear portion of the dial 1.

The display panel 3 is formed in a circular sheet having a hole 21 in the center portion, in this case, a plurality of displays 22 which display a level of a set temperature in the interior of a cabin of a vehicle are annularly disposed in the front surface of the display panel 3, and the display panel 3 is attached to a front surface of the panel support 4. The panel support 4 is concentric with the hole 21 of the display panel 3 and includes a ring portion 23 which has substantially the same diameter as that of the hole 21.

The body 5 includes a large cylindrical portion 5*b* and a small cylindrical portion 5*c* which are concentrically disposed with respect to each other in the front of a polygonal box-shaped portion 5*a*. The panel support 4 is fixed to a leading edge of the small cylindrical portion 5*c*. The dial 1 is rotatably fitted to an outer circumference of the large cylindrical portion 5*b*. As result, the display panel 3 is exposed forward from an opening portion 1*a* of the front surface of the dial 1.

In this case, a display 24 of characters (NC) of an air conditioner and a light-transmitting window 25 are provided in the front surface of the push button 6. The light guiding piece 7 is inserted to a portion which extends to the light-transmitting window 25. The push button 6 is inserted from the small cylindrical portion 5*c* of the body 5 to the ring portion 23 of the panel support 4 and exposed forward from the hole 21 of the display panel 3.

The intermediate gear 8 includes gear teeth 8*a* in the front portion and gear teeth 8*b* in the rear portion. The gear teeth 8*a* of the front portion are inserted into a hole (not shown) which is formed in the lower portion of the polygonal box-shaped portion 5*a* of the body 5 and are meshed with the gear teeth 20 of the dial 1.

The switch 9, the LED 10, and the resistors 11 to 13 are mounted on the insulator 14 from a front side, and the lamp 15 is also mounted on the insulator 14 from a rear side. Moreover, a notch 26 is formed in the lower portion of the insulator 14, the gear teeth 8*b* of the rear portion of the intermediate gear 8 are inserted into the notch 26, and therefore, the insulator 14 is combined with the body 5. In addition, a connector 27 is integrally formed in one place of the outer circumferential portion of the insulator 14, a mating connector (not shown) is connected to the connector 27, and the switch 9, the LED 10, the resistors 11 to 13, and the lamp 15 are electrically connected.

The final stage gear 16 is formed in a short cylindrical shape having a bottom, gear teeth 28 are formed in the inner circumferential portion of the gear 16, and the gear teeth 28 are meshed with the gear teeth 8*b* of the rear portion of the intermediate gear 8. In addition, a noncircular volume shaft fitting hole 29 is formed in the center portion of the final stage gear 16.

The housing 17 accommodates the final stage gear 16 and is formed in a polygonal box shape which is combined with the polygonal box-shaped portion 5*a* of the body 5 while interposing the insulator 14, and a circular volume shaft inserting hole 30 is formed in the center portion of the housing.

The volume 18 is configured such that a noncircular hollow shaft section 18*b* is projected from a case 18*a*, and a variable resistor (not shown) having a resistance value which varies the resistance value in accordance with rotation of the shaft section 18*b* is accommodated in an inner space of the case 18*a*, and the shaft section 18*b* is passed through a volume shaft inserting hole 30 of the housing 17 and is inserted and fitted into the volume shaft fitting hole 29 of the final stage gear 16. In addition, a lead wire 31 adapted to transmit a resistance output to a control device (not shown) is led out from the case 18*a* of the volume 18 to the outside.

With the above configuration, when an operator grips and rotates the dial 1 by a hand, the rotation is transmitted from the gear teeth 20 to the gear teeth 8*a* of the intermediate gear 8 at its front portion and the rotation is further transmitted from the gear teeth 8*b* of the intermediate gear 8 at its rear portion to the gear teeth 28 of the final stage gear 16. Accordingly, since the final stage gear 16 is rotated, the shaft section 18*b* is rotated through a noncircular engagement structure of the volume shaft fitting hole 29 of the final stage gear 16 and the shaft section 18*b* of the volume 18. Thereby, the resistance value of the variable resistor (not shown) in the case 18*a* is changed and its resistance output is transmitted to the control device (not shown) through the lead wire 31. As a result, the control device determines a set temperature in the interior of the vehicle corresponding to a rotation angle of the dial 1 on the basis of the received resistance output and energizes a motor (not shown) adapted to operate a dumper for controlling a temperature of air supplied to the interior of the vehicle so as to adjust the temperature.

Meanwhile, the display 22 of the display panel 3 is adapted to display the temperature adjusted as described above, and the indication piece 2 indicates a position (corresponding to the rotation angle of the dial 1) of any of the displays 22 of the display panel 3, that is, the indication piece 2 indicates a set temperature position in association with the rotation of the dial 1. At that time, the lamp 15 illuminates the entirety of the displays 22 from the back side of the displays 22. Therefore, the displays 22 has light translucency.

When an operator carries out a pressing operation of the push button 6 by a fingertip, the switch 9 which is mounted on the insulator 14 is pressed and operated, and an output thereof is transmitted to the control device through a lead wire (not shown) from the connector 27 of the insulator 14 so that an air conditioner is operated. With this, the LED 10 emits light, and the light passes through the light guiding piece 7, emerges in the light-transmitting window 25 of the push button 6, and displays the operation of the air conditioner (for example, refer to JP-A-2005-96579).

In the configuration of the related art, operational rotation of the dial 1 is transmitted to the gear teeth 8*a* of the intermediate gear 8 at the front portion from the gear teeth 20 of the dial 1 and further transmitted to the gear teeth 28 of the final stage gear 16 from the gear teeth 8*a* of the intermediate gear 8 at the rear portion so as to cause the final stage gear 16 to be rotated, and thereby the shaft section 18*b* of the volume 18 is rotated. The related art has a structure including two stages of gear transmission adapted to finally transmit the operational rotation of the dial 1 to the shaft section 18*b* of the volume 18.

A reaction or swingback referred to as a backlash inevitably exists in the transmission of rotation by gears so that the more the number of stages of gear transmission is increased, the more the backrushes are generated. Therefore, in the configuration of the related art, operational precision is lowered due to the backrushes and an adjusting operation by the dial 1 is not highly precisely performed. In addition, in the configuration of the related art, there are problems that the number of components is large and the cost is increased because of the two stages of gear transmission, and the reduction in size is difficult.

The invention is made in view of the above described circumstances, and the purpose of the invention is to provide an operating device capable of enhancing precision in an adjusting operation by a dial, and achieving reduction of cost and reduction in size by virtue of reduction of the number of components.

SUMMARY

In order to achieve the above object, according to the present invention, there is provided an operating device comprising:

a dial that has a first engagement portion;

a rotational body that is formed in an annular shape, and has a second engagement portion so as to be engaged with the first engagement portion of the dial, wherein rotation of the dial is transmitted to the rotational body through an engagement of the first and second engagement portions;

gear teeth that are provided on an inner circumferential portion of the rotational body;

a gear that is meshed with the gear teeth and is rotated in an inner space of the rotational body; and a rotation response member that is directly coupled to a rotation shaft of the gear and varies a physical amount in accordance with a rotation angle of the dial.

For example, the rotational body is arranged in an inner space of the dial.

For example, a rotational axis of the dial and the rotation shaft of the gear are coaxially arranged to each other.

For example, one of the first and second engagement portions is an engagement hole, and the other of the first and second engagement portions is an engagement projection.

In accordance with the above configurations, the operational rotation of the dial is transmitted to the rotational body through the engagement structure of the first and second engagement portions, and further transmitted from the gears to the rotation response member through the direct coupling structure thereof. Therefore, only a single stage of gear transmission is used so that it is possible to reduce the backrushes in the gear transmission. Consequently, it is possible to enhance precision in an adjusting operation by the dial. In addition, since only the single stage of the gear transmission is used, it is possible to reduce the number of components and to achieve reduction of the cost and reduction in size of the operating device in desired levels.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Hereinafter, an example (an embodiment) of the invention will be described with reference to FIGS. 1 to 3.

Figure 2:
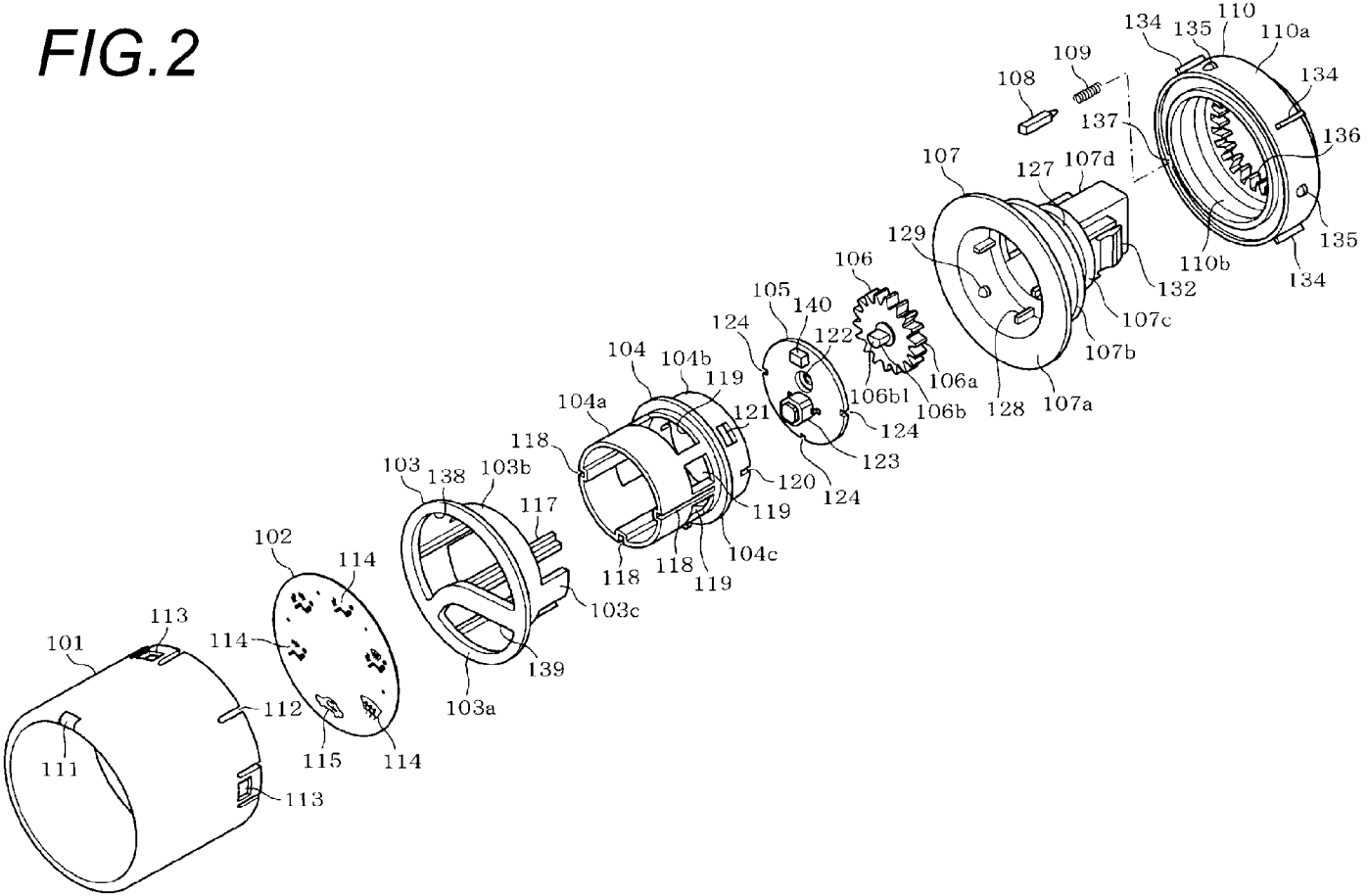
FIG. 2 is an exploded perspective view showing an entirety of the operating device according to the embodiment.

First, FIG. 2 shows, in an exploded state, an entirety of an operating device which serves as an air conditioning operation for vehicles, particularly, for automobiles and moreover serves as a switching operation of a mode of air blowing in interiors of vehicles. In FIG. 2, a dial 101, a display panel 102, a push button 103, a body 104, a circuit board 105, a gear 106, an insulator 107, a moderation piece 108, a moderation spring 109 and a rotor (rotational body) 110 are shown from the left side in this order.

Among these, the dial 101 is formed in a hollow short cylindrical shape, and includes an indication section 111 in a front edge portion at one position, and slits 112 and engagement holes (engagement portions) 113 as engagement portions in a rear edge portion, respectively at several positions.

The display panel 102 is formed of a circular sheet. In this case, a plurality of displays 114 indicating modes of blowing air in an interior of a vehicle are arranged in an annular shape on the display panel 102 at a peripheral portion of the front face thereof, and a display 115 indicating switching between inner and outer air about the blown air is also provided on the display panel 102.

In the push button 103, a diameter of a circular front face portion 103*a* is the largest, and an annular portion 103*b* is disposed behind the circular front face portion 103*a*. Extension portions 103*c* are disposed behind the annular portion 103*b* at several positions. Holes 138 and 139 are respectively formed on upper and lower parts of the circular front face portion 103*a*. As shown in FIG. 1, each of elongated projections 116 extending in a back-and-forth direction as an axial direction is provided from an inner face part of each of the extension portions 103*c* to an inner face part of the annular portion 103*b* and a switch operating projection 117 is provided on the push button 103 in the vicinity of its central portion.

The body 104 is formed in a circular cylindrical shape, and has a flange portion 104*c* which is disposed between a front portion 104*a* and a rear portion 104*b* of the body 104. In the body 4, recessed streaks 118 are provided on an outer circumferential part of the front portion 104*a* at a plurality of positions so as to correspond to the elongated projections 116 of the push button 103. Other than those, several rectangular holes 119 are provided on the body at the front portion 104*a* near the flange portion 104*c*. In addition, slits 120 and engagement holes 121 are provided on the rear portion 104*b* at several positions, respectively.

The circuit board 105 is formed in a disk shape, and a circular hole 122 is provided on the circuit board 105 in the vicinity of its central portion. A light emitting unit (for example, an LED) 140 is mounted on the circuit board 105 at a front face portion just above the hole 122 and a switch 123 is mounted thereon at the front face portion just below the hole 122. The switch 123 is, for example, a duct switch and is used to supply or cut off a current of a motor (not shown) which is adapted to operate a dumper for switching between inner and outer air about the blown air in the interior of the vehicle. In addition, recessed notch portions 124 are provided on the circuit board 105 at several positions in the outer circumferential portion thereof.

Figure 3:
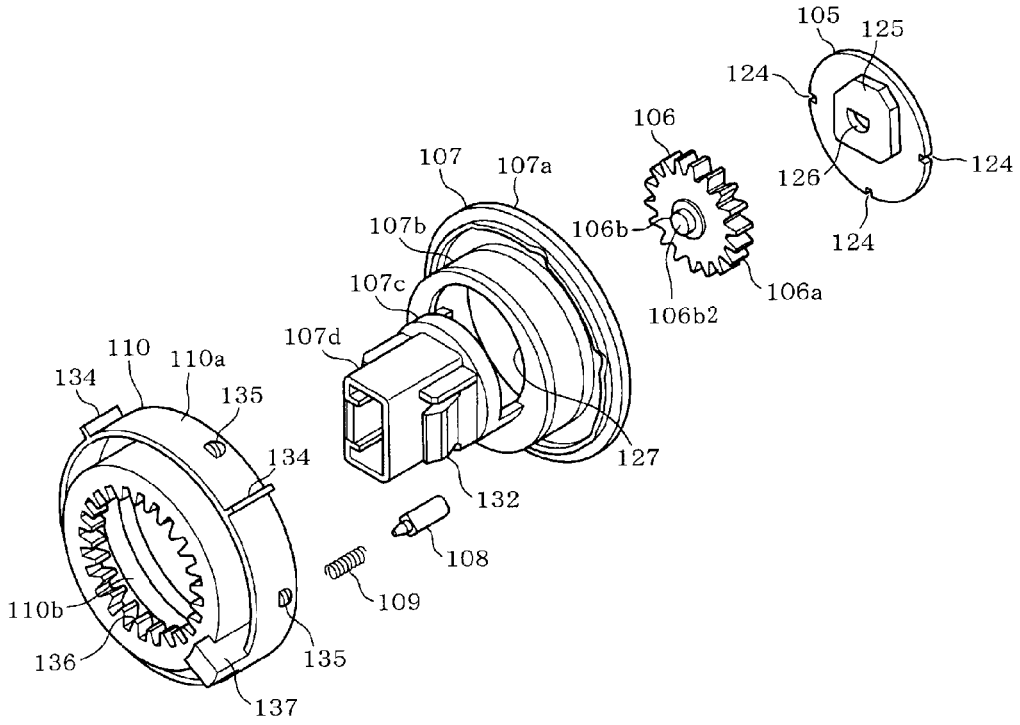
FIG. 3 is an exploded perspective view showing a part of the operating device according to the embodiment viewed from a direction opposite to that of FIG. 2.
Figure 4:
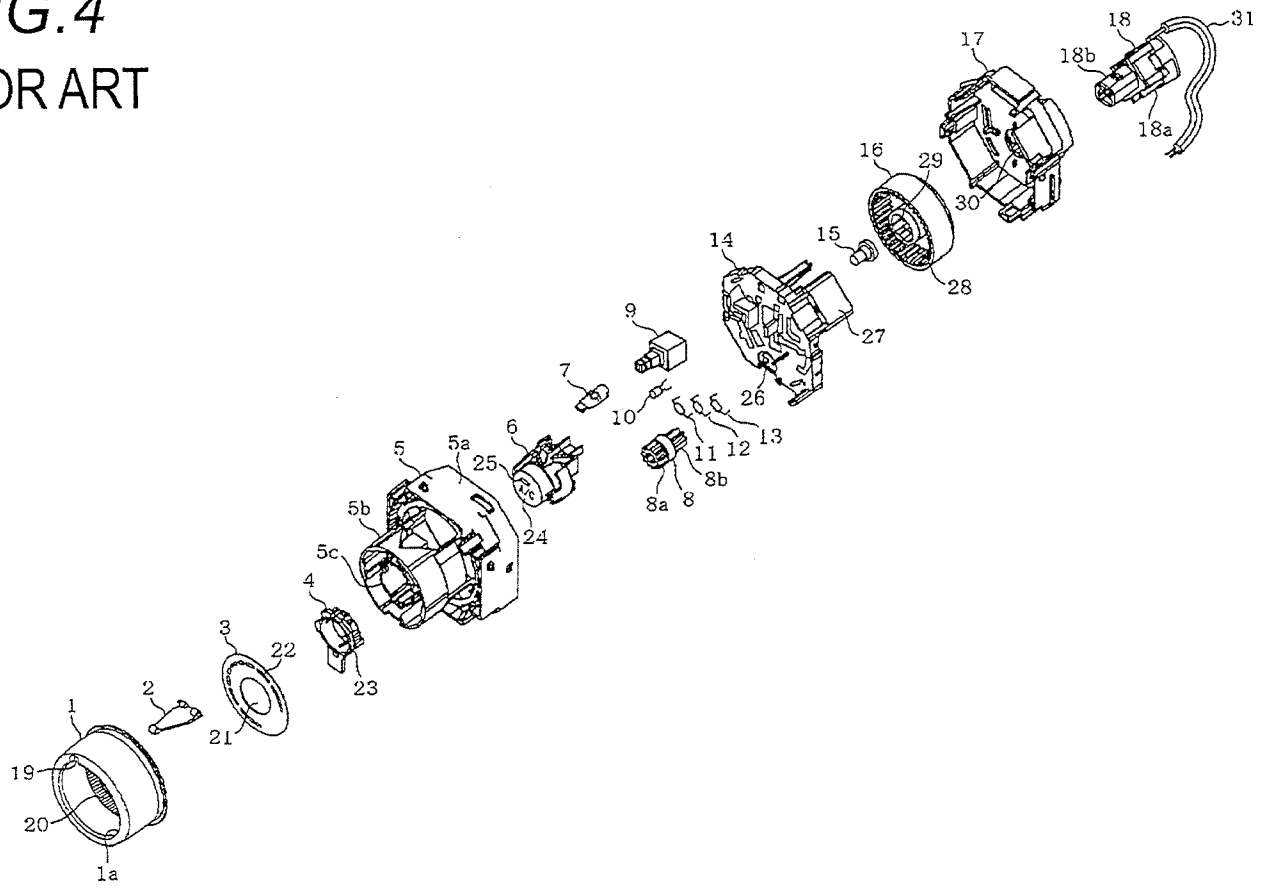
FIG. 4 PRIOR ART
FIG. 4 is a schematic view, equivalent to FIG. 2, showing an example in the related art.

Moreover, as shown in FIG. 3, a volume (rotation response member) 125 is provided on a back face of the circuit board 105. In this case, the volume 125 is formed in a chip shape and has a noncircular hole 126 in its central portion and a variable resistor element 125*a* shown in FIG. 1 provided at a peripheral portion of the hole 126.

A gear 106 is formed in a circular shape and has gear teeth 106*a* at an entirety of an outer circumferential portion thereof and a rotation shaft 106*b* at a central portion thereof. The rotation shaft 106*b* is projected in both front and rear directions of the gear 106. In the rotation shaft 106*b*, a front portion 106*b*1 is formed in a noncircular shape corresponding to the hole 126 of the volume 125 and a rear portion 106*b*2 is formed in a circular shape.

An insulator 107 has an annular flange portion 107*a* at its frontmost part, a first short circular cylindrical portion 107*b* disposed behind the annular flange portion 107*a*, a second short circular cylindrical portion 107*c* which has a bottom and a diameter smaller than that of the first short circular cylindrical portion 107*b* and is disposed behind the first short circular cylindrical portion 107*b*, and a square cylindrical portion 107*d* which has a thickness smaller than that of the second short circular cylindrical portion 107*c* and is disposed further behind the second short circular cylindrical portion 107*c*. An opening 127 is formed on the second short circular cylindrical portion 107*c* at a roughly half upper part thereof which is in contact with the first short circular cylindrical portion 107*b*.

In addition, elongated projections 128 commonly corresponding to the slits 120 of the body 104 and the recessed notch portions 124 of the circuit board 105, and engagement projections 129 corresponding to the engagement holes 121, are formed on the first short circular cylindrical portion 107*b* at its inner circumferential part. An annular bearing portion 130 corresponding to the rear portion 106*b*2 of the gear 106 is formed on the second short circular cylindrical portion 107*c* at the innermost bottom part as shown as shown in FIG. 1.

Figure 1:
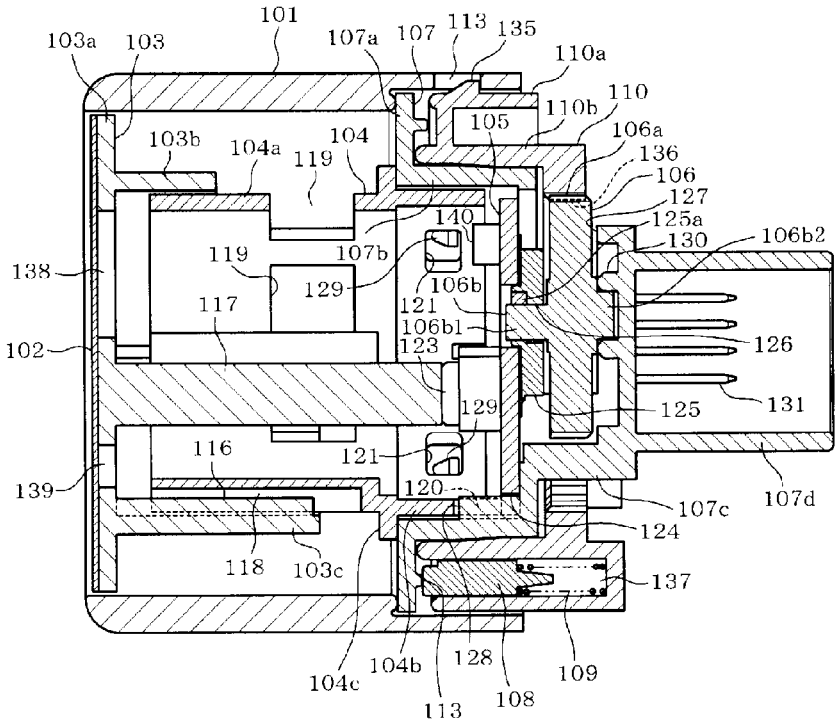
FIG. 1 is a longitudinal section side view showing an operating device according to an embodiment of the invention.

Meanwhile, the square cylindrical portion 107*d* is a connector housing section and has a plurality of connection terminals 131 in its inner part as shown in FIG. 1. It further has an engaging pawl 132, as shown in FIGS. 2 and 3, which is provided at the outside thereof and is used for connection to a mating connector housing (not shown).

Moreover, while only one is shown in FIG. 1, a plurality of click grooves 133 of which the number is matched with that of the displays 114 and 115 of the display panel 102 and the positions correspond to those of the displays 114 and 115, are formed on a back face of the flange portion 107*a* at one position thereof (omitted in FIG. 3).

A main body of the moderation piece 108 is formed in a square pole shape and the moderation spring 109 is a compression coil spring.

The rotor 110 is formed in an annular shape and has an outer annular portion 110*a* and an inner annular portion 110*b*. Elongated projections 134 corresponding to the slits 112 of the dial 101 and engagement projections 135 as engagement portions corresponding to the engagement holes 113 are formed on the outer annular portion 110*a* at an outer circumferential part. In addition, gear teeth 136 are formed on the inner annular portion 110*b* in an entire inner circumferential part at the rear side thereof. Moreover, as shown in FIG. 1, a bag portion 137 is formed at one position between the outer annular portion 110*a* and the inner annular portion 110*b* corresponding to the click grooves 133.

As shown in FIG. 1, in the above configuration, the display panel 102 is stuck to a front face of the push button 103 and the push button 103 is inserted into the dial 101. Next, the body 104 is inserted into the dial 101. While the recessed streaks 118 of the body 104 are fitted to the elongated projections 116 of the push button 103, the front portion 104*a* is inserted into the push button 103.

On the other hand, the gear 106 is accommodated in a space of the second short circular cylindrical portion 107*c* of the insulator 107, the gear teeth 106*a* are exposed from the opening 127 and the rear portion 106*b*2 of the rotation shaft 106*b* is fitted to the bearing portion 130. Based on the above, while the recessed notch portions 124 of the circuit board 105 are fitted to the elongated projections 128 of the insulator 107, the circuit board 105 is accommodated in the first short circular cylindrical portion 107*b* of the insulator 107 so as to be positioned at its innermost part, and thereby the hole 122 of the circuit board 105 is fitted to the front portion 106*b*1 of the rotation shaft 106*b* of the gear 106 through the hole 126 of the volume 125. Accordingly, rotation of the circuit board 105 is stopped with respect to the insulator 107 by the elongated projections 128 of the insulator 107, and the rotation shaft 106*b* of the gear 106 is pivoted by the bearing portion 130 of the insulator 107 and the hole 126 of the volume 125. The rotation shaft 106*b* of the gear 106 is directly coupled to the volume 125.

After that, the first short circular cylindrical portion 107*b* of the insulator 107 is fitted to the rear portion 104*b* of the body 104. While the elongated projections 128 are fitted and guided to the slits 120, the engagement projections 129 are engaged with the engagement holes 121. Accordingly, rotation of the body 104 is stopped by the engagement projection 129 of the insulator 107.

After that, the moderation spring 109 and the moderation piece 108 are sequentially accommodated in the bag portion 137 of the rotor 110, the inner annular portion 110*b* is fitted to the first short circular cylindrical portion 107*b* of the insulator 107, and the gear teeth 136 are meshed with the gear teeth 106*a* of the gear 106 exposed from the opening 127 of the second short circular cylindrical portion 107*c*. In addition, at the same time, while the elongated projections 134 of the rotor 110 are fitted and guided to the slits 112 of the dial 101, the engagement projections 135 are engaged with the engagement holes 113. The moderation piece 108 is pressed to be engaged with the moderation valley 133 of the insulator 107 by a spring force of the moderation spring 109. Thus, the entirety of the operating device is assembled.

Meanwhile, the circuit board 105 is connected to the connection terminals 131 at a position where the circuit board 105 is placed on an innermost part of the first short circular cylindrical portion 107*b* of the insulator 107. Female side connection terminals (not shown) of a mating connector to be connected to the square cylindrical portion 107*d* (a connector housing portion) of the insulator 107, are adapted to be fitted and connected to the connection terminals 131.

In the case of the configuration described above, when an operator holds the dial 101 by a hand and operates and rotates the dial 101 so as to cause the indication section 111 to indicates any of the displays 114 of the display panel 102, the rotor 110 is rotated through the engagement structure of the engagement holes 113 of the dial 101 and the engagement projections 135 of the rotor 110. Therefore, the rotor 110 is a rotational body to which the rotation of the dial 101 is transmitted through the engagement structure of the rotor 110 and the dial 101. When the rotor 110 as the rotational body is rotated, the gear 106 is rotated centering around the rotation shaft 106*b* through meshing between the gear teeth 136 of the rotor 110 and the gear teeth 106*a* of the gear 106.

The rotated gear 106 applies its rotation to the volume 125 through engagement (direct coupling) between the noncircular front portion 106*b*1 of the rotation shaft and the noncircular hole 126 of the volume 125. In the volume 125, the applied rotation causes a resistance value of the variable resistor element 125*a* to vary physical amount (for example, resistance value, angle, rotation amount, posture, light volume, and so on) corresponding to a rotation angle of the dial 101. Therefore, the volume 125 is a rotation response member which varies the physical amount in accordance with the rotation angle of the dial 101. As the rotation response member, other than the above, an optical sensor, a rotary encoder or the like can be used.

Meanwhile, a resistance output (an output of the rotation response member) of the volume 125 is transmitted to a control device (not shown) from the connection terminals 131 of the first short circular cylindrical portion 107*b* (the connector housing portion) of the insulator 107 through female side connection terminals of a mating connector connected to the connection terminals 131 and lead wires (not shown) connected thereto. As a result, the control device determines, in this case, a mode of blowing air to an interior of a vehicle corresponding to the rotation angle of the dial 101 on the basis of the received output. Accordingly, the control device supplies electrical power to the motor (not shown) adapted to operate the dumper for switching a blowing direction of air to be supplied in the interior of the vehicle, and thereby switches the blowing direction of the air.

In addition, the switching is performed with click feeling in such a manner that the indication section 111 of the dial 101 is matched with each of the displays 114 of the display panel 102. The click feeling is obtained such that the click piece 108 is engaged with each of the click grooves 133 of the insulator 107 by the spring force of the moderation spring 109. The displays 114 are illuminated by the light emitting unit 140 through the holes 138 and 139 of the push button 103, and therefore the displays 114 have translucency.

In addition, when the push button 103 is operated to be pushed from the front face of the display panel 102, the elongated projections 116 are guided to the recessed streaks 118 of the body 104, and thereby the push button 103 is moved backward. By the movement, the switch 123 at the front face of the circuit board 105 is pressed by the switch operating projection 117, and thereby the switch 123 is operated. An output by the operation of the switch 123 is to be transmitted to a control device (not shown) from the connection terminals 131 of the insulator 107. Herewith, the motor (not shown) adapted to operate the dumper for switching between inner and outer air about air blown in the interior of the vehicle is energized, and thereby the switching between inner and outer air is performed. Meanwhile, when the pressing operation of the push button 103 is released, the push button 103 is restored by a restoring force of the switch 123.

Thus, in accordance with the operating device having the above configuration, the operational rotation of the dial 101 is transmitted to the rotor 110 as the rotational body through the engagement structure of the engagement holes 113 as engagement portions thereof and the engagement projections 135 as engagement portions. While the operational rotation is further transmitted from the gear teeth 136 of the rotor 110 to the gear 106, the operational rotation is transmitted from the gear 106 to the volume 125 as the rotation response member by the direct coupling structure thereof. Therefore, only a single stage of gear transmission is used so that it is possible to reduce backrushes in the gear transmission. Consequently, by reducing influence of backrushes to the gear transmission, it is possible to enhance the precision in the adjusting operation by the dial 101. In addition, since only the single stage of gear transmission is used, it is possible to reduce the number of components and to achieve reduction of the cost and reduction in size of the operating device in desired levels.

Meanwhile, the engagement projections 135 can be provided on the dial 101 as engagement portions and the engagement holes 113 can be provided on the rotor 110 (the rotational body) as engagement portions.

In addition, an operational target of the dial 101 is not limited to an air conditioning operation for vehicles such as automobiles or the like, particularly, to a switching operation of a mode of blowing air in an interior of a vehicle, but it can be a controlling operation of a flowrate of air or a temperature and also can be an operation other than the above. In addition, to be consistent with the above, the switch 123 operated by the push button 6 is not limited to one adapted to switch between inner and outer air about air blown in an interior of a vehicle, but it can be one used for an on-off operation of an air conditioner or a defogger for a rear window, and further can be one used for an on-off operation of a device other the above devices. Moreover, the operating device is not necessarily provided with the switch 123 and the structure relating to its operation.

Meanwhile, the invention is not limited to the embodiment described above with reference to the drawings, but modifications can be made, if necessary, without departing from the essence of the invention.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2012-002181 filed on Jan. 10, 2012, the contents of which are incorporated herein by reference.

What is claimed is:

1. An operating device comprising:

a dial that has a first engagement portion;

a rotational body that is formed in an annular shape, and has a second engagement portion so as to be engaged with the first engagement portion of the dial, wherein rotation of the dial is transmitted to the rotational body through an engagement of the first and second engagement portions; gear teeth that are provided on an inner circumferential portion of the rotational body;

a gear that is meshed with the gear teeth and is rotated in an inner space of the rotational body; and a rotation response member that is directly coupled to a rotation shaft of the gear and varies a physical amount in accordance with a rotation angle of the dial;

wherein a rotational axis of the dial and the rotation shaft of the gear are coaxially arranged to each other.

2. The operating device according to claim 1, wherein the rotational body is arranged in an inner space of the dial.

3. The operating device according to claim 1, wherein one of the first and second engagement portions is an engagement hole, and the other of the first and second engagement portions is an engagement projection.

4. The operating device according to claim 1, wherein the rotation response member outputs a signal based on variation of the physical amount.

5. The operating device according to claim 1, wherein a rotation shaft of the gear having a noncircular shape is engaged with a noncircular hole of the rotation response member.

6. The operating device according to claim 1, wherein the rotation response member is provided on a back face of a circuit board.

7. The operating device according to claim 1, wherein the gear is rotated by the gear teeth of the rotational body so that rotation number of the gear is different from rotation number of the rotational body.

8. The operating device according to claim 1, wherein the gear includes gear teeth that are formed on an outer peripheral surface of the gear and are meshed with the gear teeth of the rotational body.

* * * * *